US006298801B1

(12) United States Patent
May

(10) Patent No.: US 6,298,801 B1
(45) Date of Patent: Oct. 9, 2001

(54) EXTENDABLE DECK ASSEMBLY FOR A BOAT

(76) Inventor: Lindy Lawrence May, P.O. Box 399, Strafford, MO (US) 65757

( * ) Notice: Subject to any disclaimer, the term of this patent is extended or adjusted under 35 U.S.C. 154(b) by 0 days.

(21) Appl. No.: 09/565,938

(22) Filed: May 5, 2000

Related U.S. Application Data

(63) Continuation-in-part of application No. 08/936,177, filed on Sep. 24, 1997, now Pat. No. 6,058,866, which is a continuation-in-part of application No. 08/824,821, filed on Mar. 26, 1997, now abandoned.

(51) Int. Cl.[7] ..... B63B 3/48
(52) U.S. Cl. ..... 114/85; 114/364
(58) Field of Search ..... 114/85, 343, 362, 114/364, 61.1, 72, 60; 14/69.5, 71.1, 71.7; 414/537

(56) References Cited

U.S. PATENT DOCUMENTS

| | | | | |
|---|---|---|---|---|
| 2,669,733 | | 2/1954 | Picker | 114/362 |
| 3,052,896 | | 11/1962 | Beach | 114/362 |
| 3,155,258 | | 11/1964 | Fincannon | 414/537 |
| 3,229,833 | | 1/1966 | Heck et al. | 414/537 |
| 3,468,280 | * | 9/1969 | Williams | 114/72 |
| 3,511,393 | | 5/1970 | Abromavage et al. | 414/537 |
| 3,613,137 | | 10/1971 | Eccles . | |
| 3,792,502 | | 2/1974 | Odegaard | 114/61 |
| 3,925,837 | | 12/1975 | Miller | 114/61 |
| 4,085,473 | | 4/1978 | Franklin . | |
| 4,293,967 | | 10/1981 | Ord | 114/362 |
| 4,354,447 | | 10/1982 | Hultgren | 114/343 |
| 4,624,619 | | 11/1986 | Uher | 414/537 |
| 4,971,315 | | 11/1990 | Rector | 114/61 |
| 4,993,341 | | 2/1991 | Merkel | 114/362 |
| 5,085,165 | | 2/1992 | Reed | 114/362 |
| 5,123,372 | | 6/1992 | Kobayashi et al. | 114/362 |
| 5,136,963 | | 8/1992 | Zuzik . | |
| 5,170,741 | | 12/1992 | Magers et al. . | |
| 5,542,370 | | 8/1996 | Castleberry . | |
| 6,058,866 | * | 5/2000 | May | 114/85 |

FOREIGN PATENT DOCUMENTS

| | | | |
|---|---|---|---|
| 61-271191 | 12/1986 | (JP) | 114/343 |
| 61-271195 | 12/1986 | (JP) | 114/343 |

* cited by examiner

*Primary Examiner*—Sherman Basinger
(74) *Attorney, Agent, or Firm*—Polster, Lieder, Woodruff & Lucchesi

(57) ABSTRACT

An extendable deck assembly for a boat to provide additional use area of the boat while on the lake. In the retracted position the extendable deck permits a smaller trailer to be used for transporting the boat and provide better maneuverability on the lake. The extendable deck provides use area in the retracted position as well as the extended position, thereby eliminating stowing problems. The extendable deck assembly may be provided with rollers or an actuating device to facilitate the sliding movement of the extendable deck. The extendable deck assembly is designed to accommodate the side curvature of the boat and may be a built-in feature of the boat or may be marketed independently.

11 Claims, 15 Drawing Sheets

EXTENDABLE DECK ASSEMBLY FOR A BOAT

CROSS-REFERENCE TO RELATED APPLICATIONS

This application is a Continuation-in-part of application Ser. No. 08/936,177, Sep. 24, 1997, allowed U.S. Pat. No. 6,058,866, which is a Continuation-in-part of application Ser. No. 08/824,821, Mar. 26, 1997, now abandoned.

STATEMENT REGARDING FEDERALLY SPONSORED RESEARCH OR DEVELOPMENT

Not Applicable.

BACKGROUND OF THE INVENTION

The general use area of a conventional fishing or recreational boat is restricted to the area within the perimeter of the boat. It is often desired to have additional use area within the boat after the boat has reached its destination on the lake. Larger boats are more costly and require longer, more costly trailers to haul them. Larger boats are also more difficult to maneuver in the parking lot as well as in the lake. Portable or hinged deck extensions provide minimal use area, are cumbersome to use, and create problems to stow when they are not in use or when the boat is being transported.

BRIEF SUMMARY OF THE INVENTION

It is thus a principal object of the present invention to provide an extendable deck assembly for a boat; thereby providing additional use area while the boat is on the lake.

Another object of this invention is to provide an extendable deck assembly for a boat in which the extendable deck is easily extended and retracted in a sliding manner.

A still further object of this invention is to provide an extendable deck assembly for a boat in which the sliding movement of the extendable deck is facilitated by rollers.

A still further object of this invention is to provide an extendable deck assembly for a boat in which the sliding movement of the extendable deck is provided by an actuating device.

Another object of this invention is to provide an extendable deck assembly for a boat in which the extendable deck provides general use area in the retracted position as well as in the extended position, thereby eliminating stowing problems.

It is still another object of this invention to provide an extendable deck assembly for a boat in which the extendable deck compensates for any tilting of the boat when the extendable deck is in the extended position, thereby providing a more level floor surface in the extended position.

It is still another object of this invention is to provide an extendable deck assembly for a boat which is adapted with mounting brackets so as to permit the assembly to be marketed separately and installed by the consumer on existing boats.

These and other objects will become apparent hereinafter.

BRIEF DESCRIPTION OF THE SEVERAL VIEWS OF THE DRAWINGS

In the drawings.

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
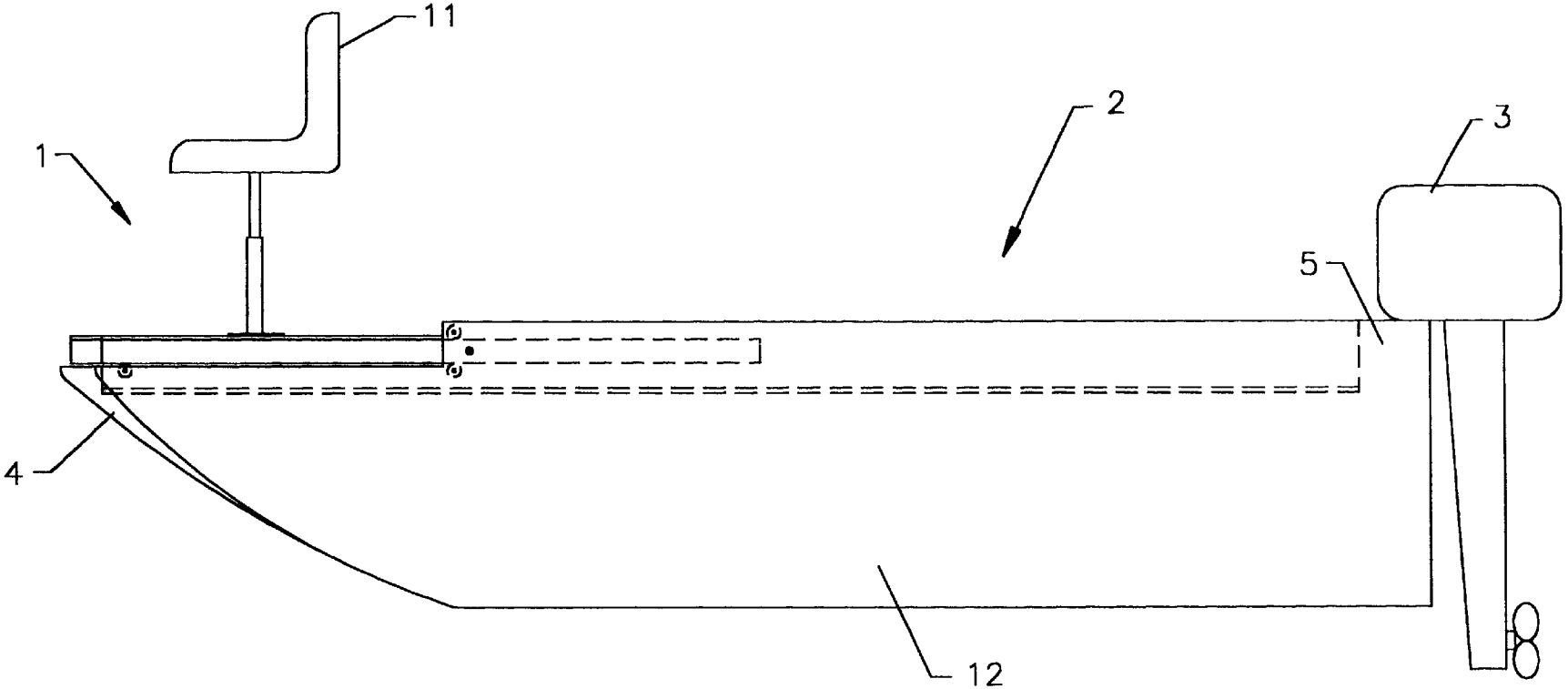
FIG. 1 is a side elevation view of a boat adapted with an extendable deck assembly shown with the deck in the retracted position.

Referring to FIG. 1, there is provided an extendable deck assembly 1 of the present invention. The extendable deck assembly 1 is slidably mounted to a boat 2, more specifically to the bow end 4 of the boat 2. The boat 2 has a longitudinal axis extending from the bow 4 to a stern 5. The stern 5 of the boat 2 is adapted with an outboard motor 3. The extendable deck assembly 1 is shown as a built-in feature of the boat 2 and is illustrated in the retracted position.

The present invention is demonstrated on a boat 2 having a hull 12 for the purposes of this disclosure. It is not intended to imply that the extendable deck assembly 1 of the present invention is limited to this type of boat as the invention may be adapted to various types of boats such as pontoon boats. The terms "slidably mounted," "sliding movement," or the like are intended to define directional motion and are not intended to imply the necessity of the existence of sliding friction such as two surfaces rubbing against one another.

Figure 2:
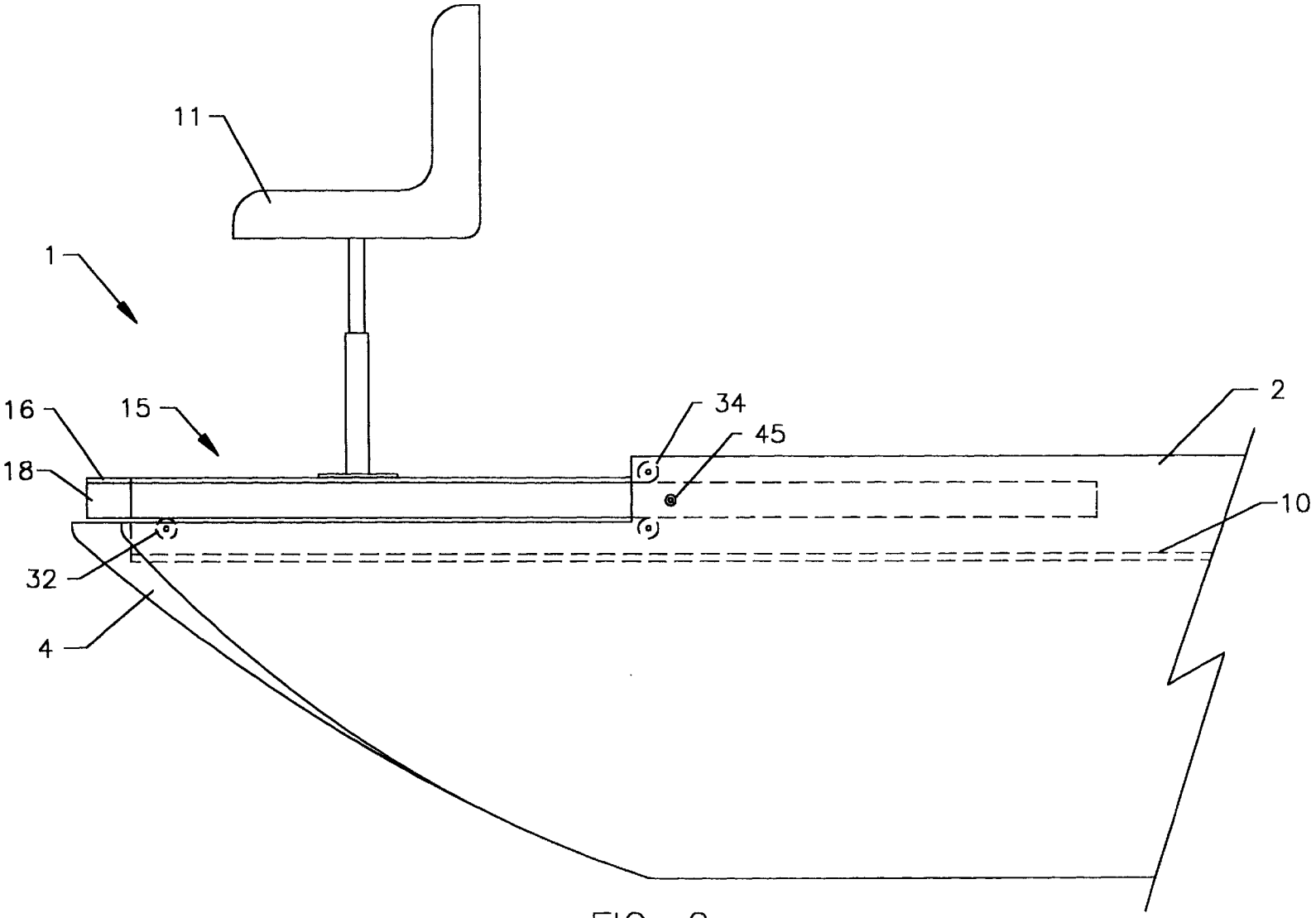
FIG. 2 is an enlarged side elevation view of the extendable deck assembly of FIG. 1.
Figure 3:
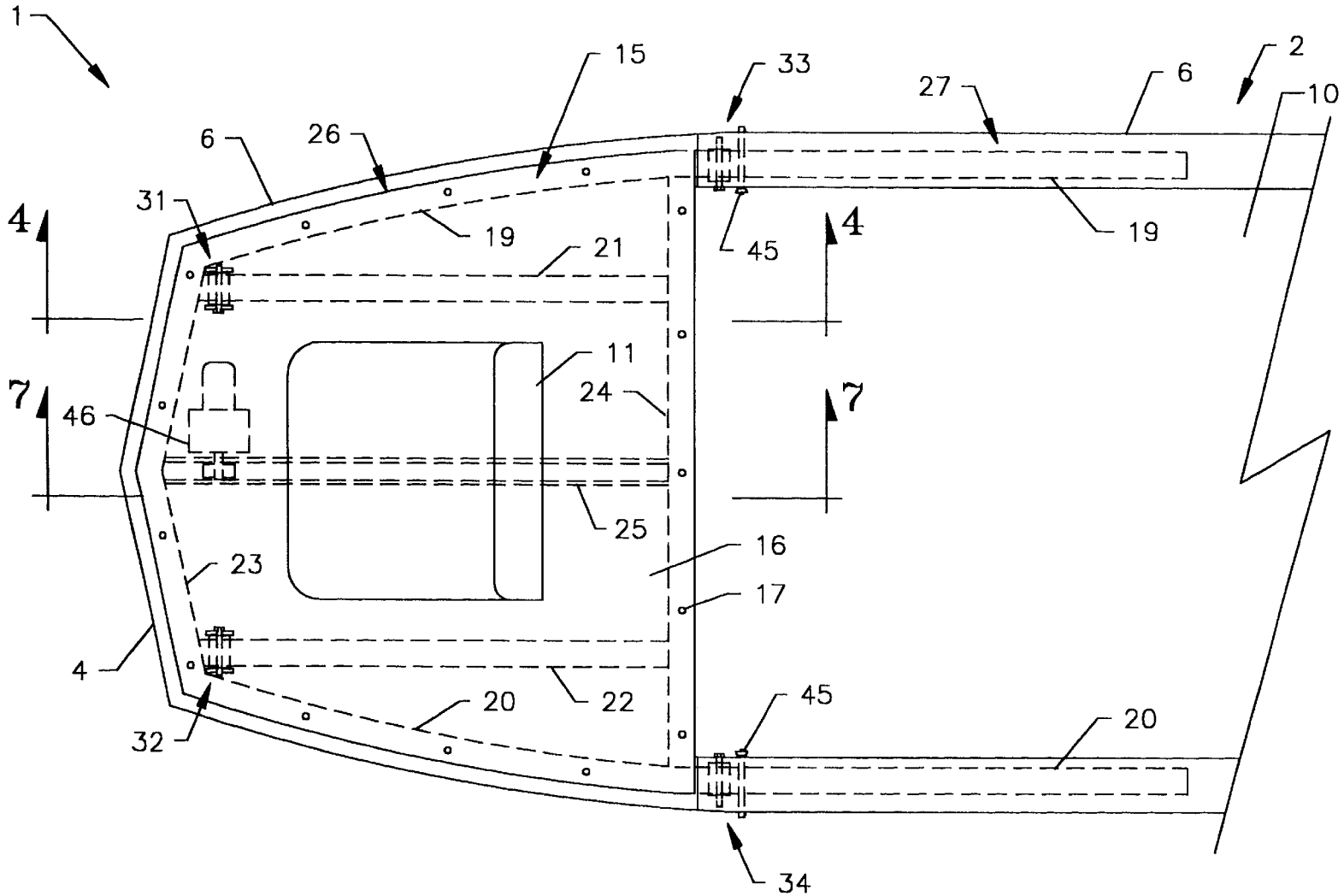
FIG. 3 is a plan view of FIG. 2 with the extendable deck shown in the retracted position.

Referring to FIGS. 2 through 7, the extendable deck assembly 1 is more clearly detailed. The extendable deck assembly 1 is comprised of six primary components which are the extendable deck 15, the two front guide roller assemblies 31, 32, the two back guide roller assemblies 33, 34, and the gearmotor assembly 46, as seen in FIG. 3.

The extendable deck 15 is comprised of a deck platform 16 secured to a frame structure 18, as seen in FIG. 2. The frame structure 18 is constructed with structural channel which may be aluminum, fiberglass, or any durable material. The frame structure 18 is comprised of two outer guide rails 19, 20, two inner guide rails 21, 22, a front deck support member 23, a back deck support member 24, and a center deck support member 25, as seen in FIG. 3. The front portion 26 of each outer guide rail 19, 20 is formed to match the curvature of the boat sidewall 6 with the back portion 27 of each outer guide rail 19, 20 remaining straight and parallel to each other. The deck platform 16 is constructed from marine-grade plywood and is secured to the frame structure 18 with sheet metal screws 17. The deck platform 16 may be provided with various coverings including paint or carpeting. The extendable deck 15 is illustrated equipped with a pedestal seat 11 to illustrate one use of the extendable deck assembly 1 for purposes of this disclosure and it is not intended to imply that the extendable deck assembly 1 is limited to this use as the extendable deck 15 may be outfitted with various other boating accessories such as a trolling motor, lights, railing, bench seats, etc.

The front guide roller assemblies 31, 32 and the back guide roller assemblies 33, 34 provide the means to guide the extendable deck 15 to the extended position and back to the retracted position in a sliding manner. The front guide roller assemblies 31, 32 interface with the inner guide rails 21, 22 and the back guide roller assemblies 33, 34 interface with the outer guide rails 19, 20 of the extendable deck 15, as seen in FIG. 3. This offset design of the front guide roller assemblies 31, 32 relative to the back guide roller assemblies 33, 34 permits the extendable deck 15 to match the curvature of the boat sidewall 6.

Figure 4:
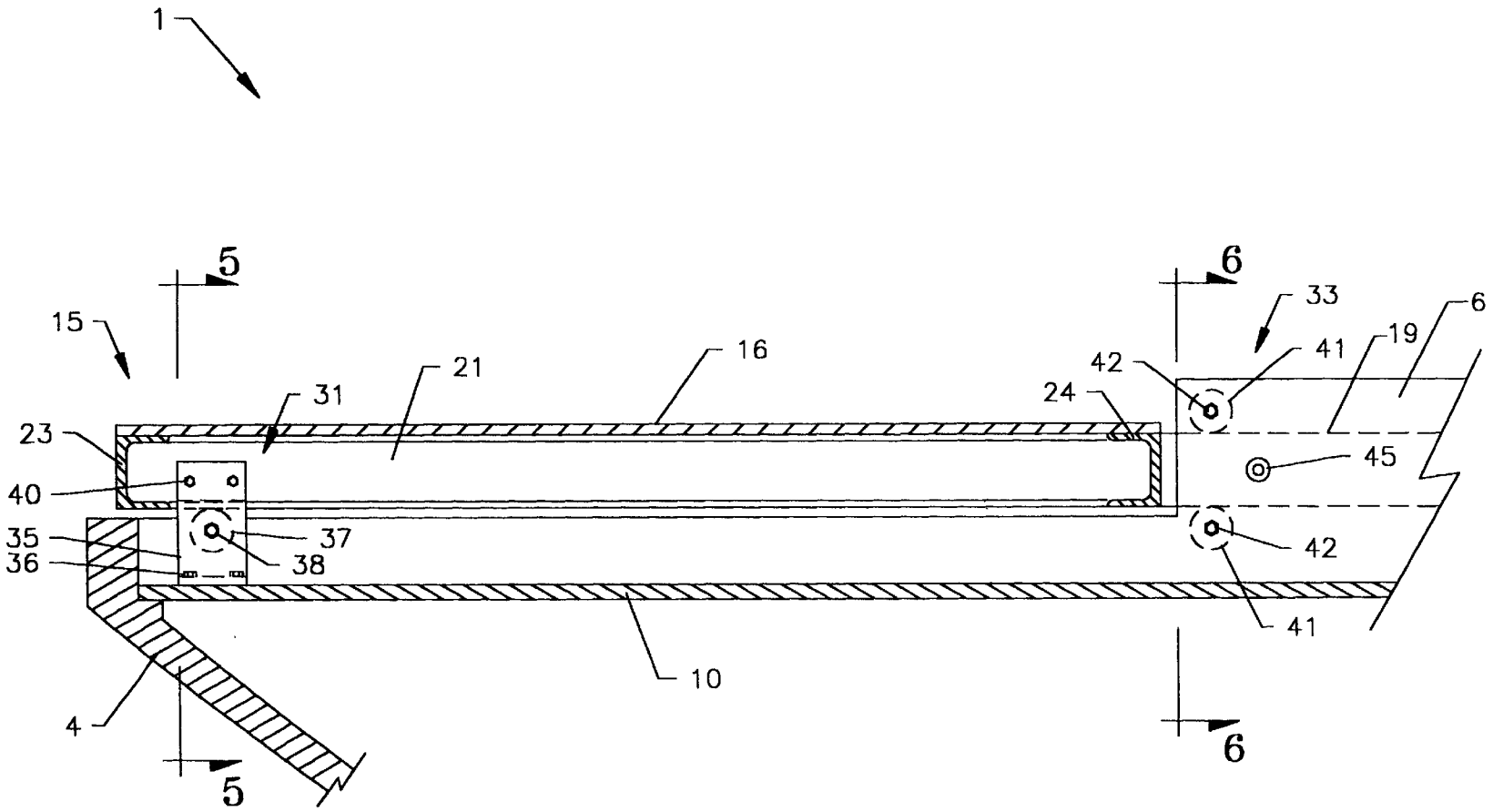
FIG. 4 is a horizontal section view taken along line 4—4 of FIG. 3.
Figure 5:
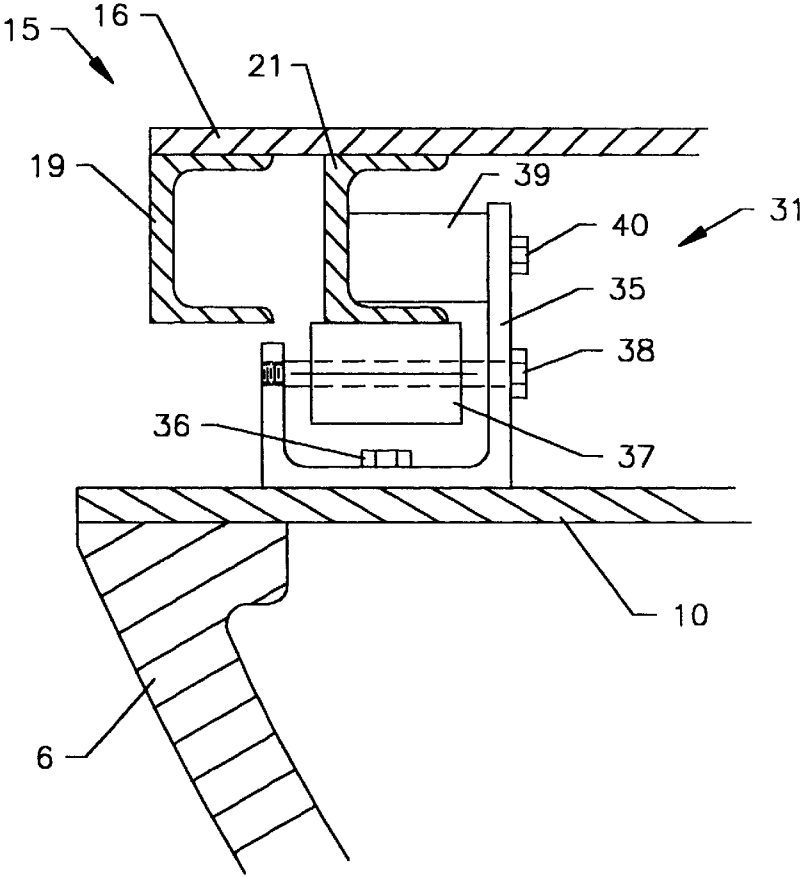
FIG. 5 is a vertical section view taken along line 5—5 of FIG. 4.

Each front guide roller assembly 31, 32 is comprised of a guide roller bracket 35, a guide roller 37, and a guide block 39 as seen in FIGS. 4 and 5 which illustrate the right front guide roller assembly 31. The guide roller bracket 35 is constructed of sheet metal and is secured to the stationary deck 10 of the boat 2 with mounting bolts,36, as shown. The guide roller 37 is constructed of delrin or similar material and is rotatably mounted to the guide roller bracket 35 by means of a shoulder bolt 38. The guide roller 37 supports the inner guide rail 21 and facilitates the sliding movement of the extendable deck 15. The guide block 39 is also constructed of delrin or similar material and is secured to the guide roller bracket 35 by means of two mounting bolts 40. The guide block 39 prevents the inner guide rail 21 from sideward movement in the direction of the guide block 39. The guide block 39 also prevents upward movement of the inner guide rail 21 relative to the guide roller 37. The left front guide roller assembly 32 is constructed in the same manner as the right front guide roller assembly 31 and interfaces with the left inner guide rail 22. The guide blocks 39 of the right front guide roller assembly 31 and the left front guide roller assembly 32 work in unison to prevent sideward movement of the extendable deck 15 to the right or to the left relative to the front guide roller assemblies 31, 32.

Figure 6:
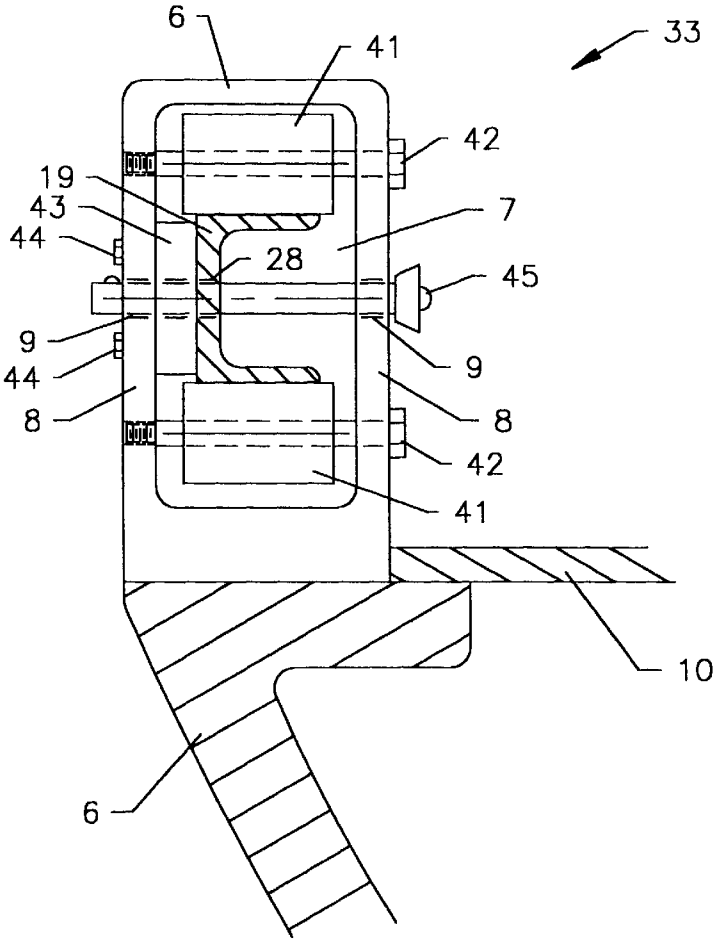
FIG. 6 is a vertical section view taken along line 6—6 of FIG. 4.

The back guide roller assemblies 33, 34 are built-in to the sidewalls 6 of the boat 2. A cavity 7 in each sidewall 6 provides a housing for the back guide roller assemblies 33, 34. Each back guide roller assembly 33, 34 provides two guide rollers 41 as seen in FIGS. 4 and 6 which illustrate the right back guide roller assembly 33. The guide rollers 41 are constructed of delrin or similar material and are rotatably mounted in the boat sidewall cavity 7 by means of a shoulder bolt 42. The guide rollers 41 provide support for the outer guide rail 19 and facilitate the sliding movement of the extendable deck 15. Each back guide roller assembly 33, 34 also provides a guide block 43. The guide block 43 is constructed of delrin or similar material and is secured in the boat sidewall cavity 7 by means of two mounting bolts 44. The guide block 43 prevents the outer guide rail 19 from sideward movement in the direction of the guide block 43. The left back guide roller assembly 34 is constructed in the same manner as the right back guide roller assembly 33 and interfaces with the left outer guide rail 20. The guide blocks 43 of the right back guide roller assembly 33 and the left back guide roller assembly 34 work in unison to prevent sideward movement of the extendable deck 15 to the right or to the left relative to the back guide roller assemblies 33, 34. Each boat sidewall cavity 7 is provided with a hole 9 through each side 8 to interface with the quick pins 45, as seen in FIG. 6. The back portion 27 of each outer guide rail 19, 20 is adapted with two holes 28 to interface with the quick pins 45. The quick pins 45 are used to retain the extendable deck 15 in the extended and retracted positions as they interface with the appropriate hole 28 in the outer guide rails 19, 20 and the holes 9 in the boat sidewall cavities 7.

Figure 7:
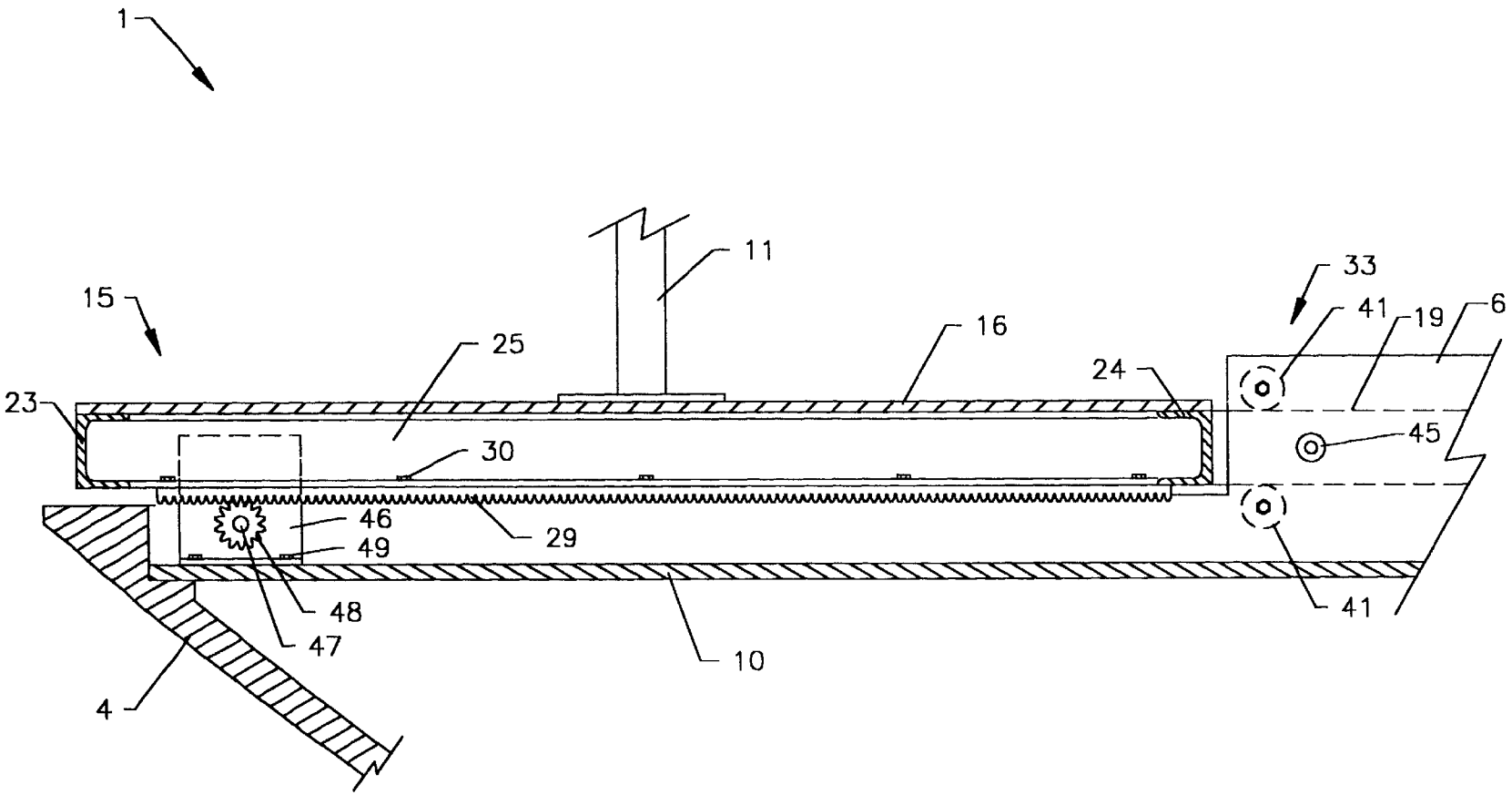
FIG. 7 is a horizontal section view taken along line 7—7 of FIG. 3.

The sliding movement of the extendable deck assembly 1 may be facilitated with an actuating device. A 12-volt D.C. gearmotor 46 is mounted to the stationary deck 10 by means of mounting bolts 49, as seen in FIGS. 3 and 7. A gear rack 29 is mounted under the center deck support member 25 by means of mounting bolts 30, as seen in FIG. 7. The output shaft 47 of the gearmotor 46 is adapted with a pinion gear 48. The pinion gear 48 interfaces with the gear rack 29.

Figure 8:
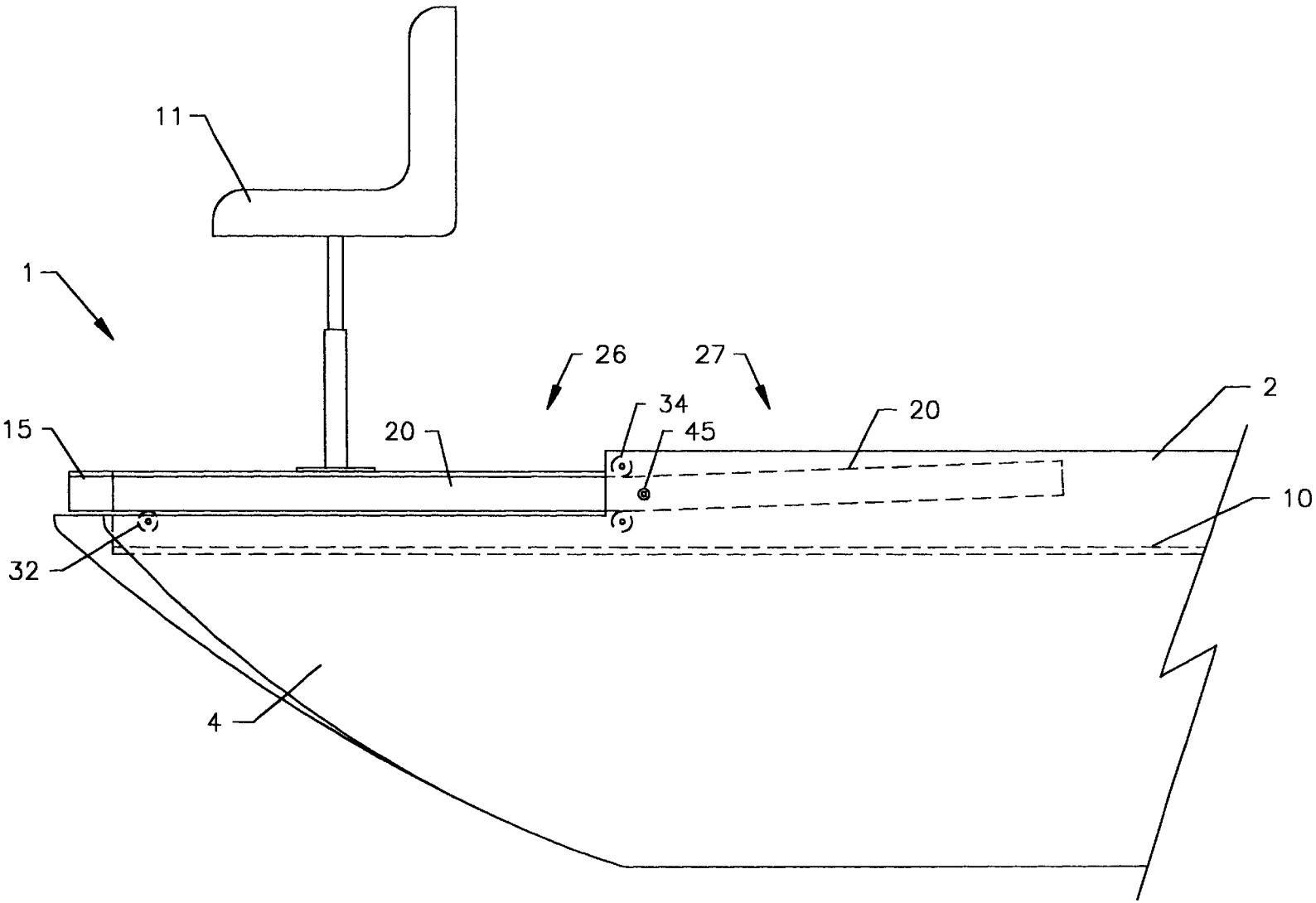
FIG. 8 is a side elevation view of a boat adapted with an extendable deck assembly in which the outer guide rails are slanted slightly upward, shown with the deck in the retracted position.
Figure 9:
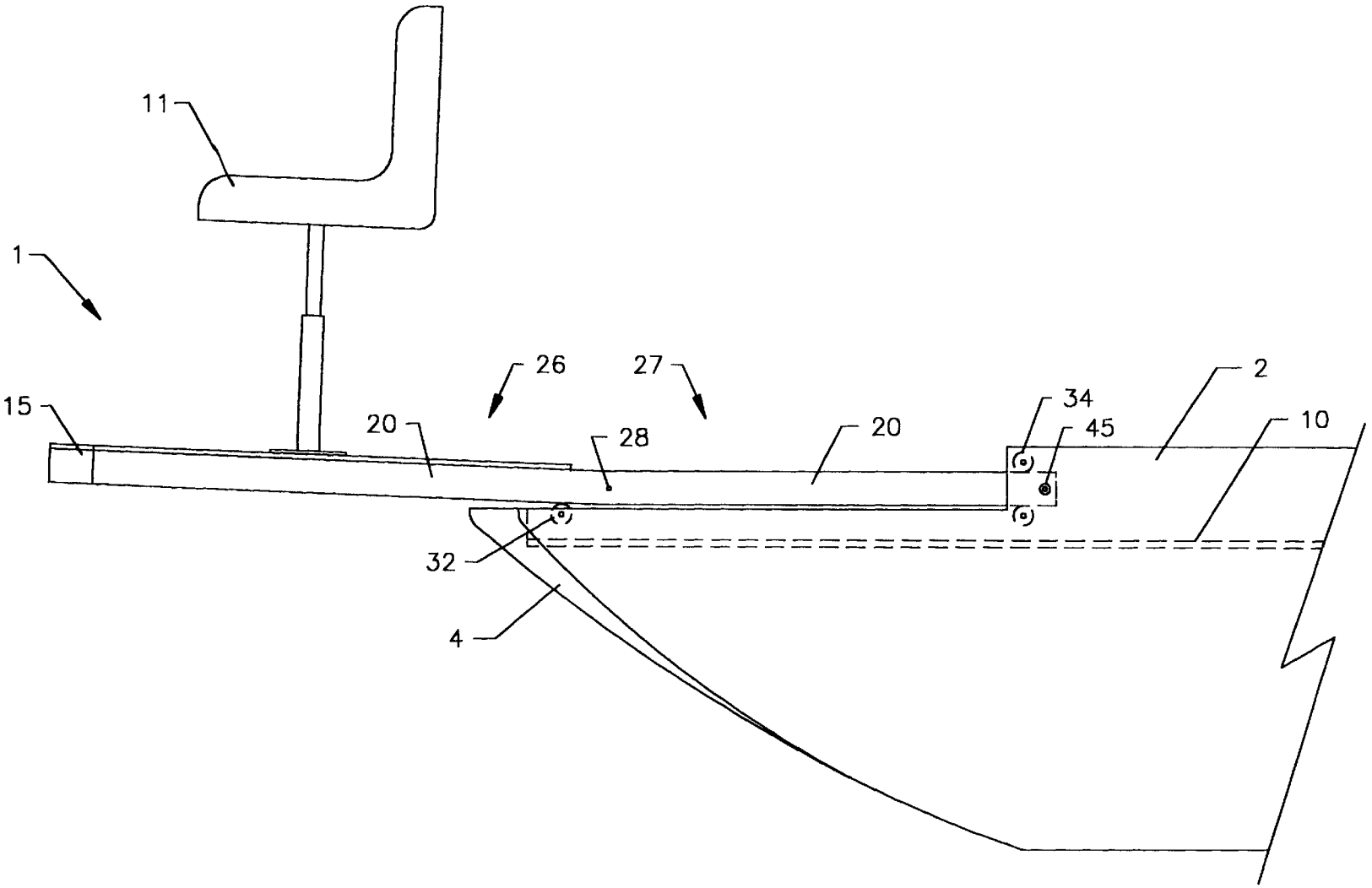
FIG. 9 is a side elevation view of FIG. 8, shown with the deck in the extended position.
Figure 10:
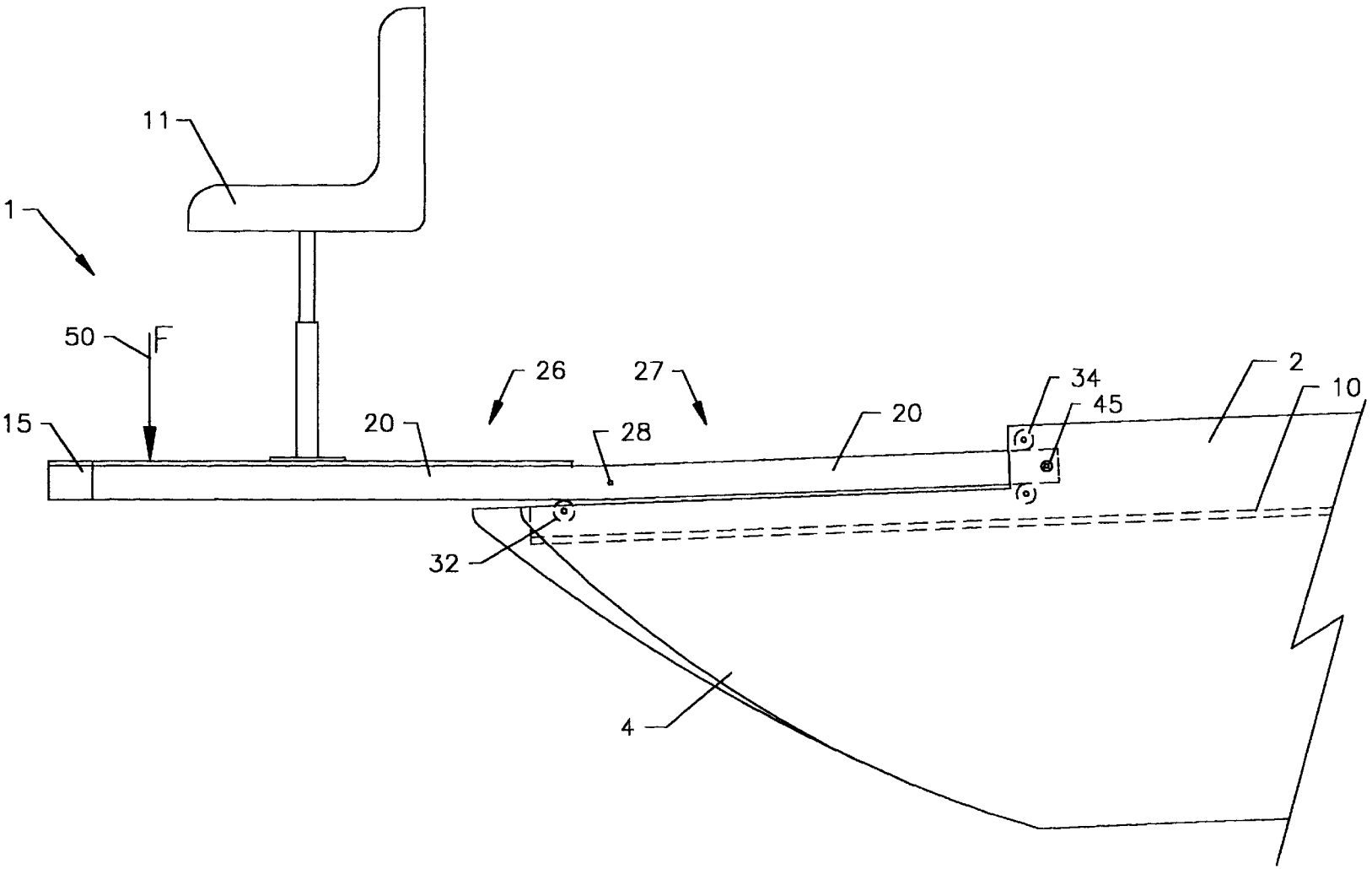
FIG. 10 is a side elevation view of FIG. 9, shown with the deck in the extended position and loaded

Referring to FIGS. 8 through 10, the extendable deck assembly 1 is provided with the outer guide rails 19, 20 formed such that the back portion 27 is slanted slightly upward relative to the front portion 26, as seen in FIG. 8. This option should be used on boats which significantly tilt forward due to the overhung load caused by the extendable deck 15. The extendable deck 15 is level relative to the boat 2 when the extendable deck 15 is in the retracted position. When the extendable deck 15 is in the extended position, the extendable deck 15 is slanted slightly upward relative to the boat 2, as seen in FIG. 9. When a load 50 is placed on the extendable deck 15 in the extended position, the boat 2 may tilt forward due to the overhung load. This will cause the extendable deck 15 to level relative to the water, thereby compensating for the tilting of the boat 2, as seen in FIG. 10.

Figure 11:
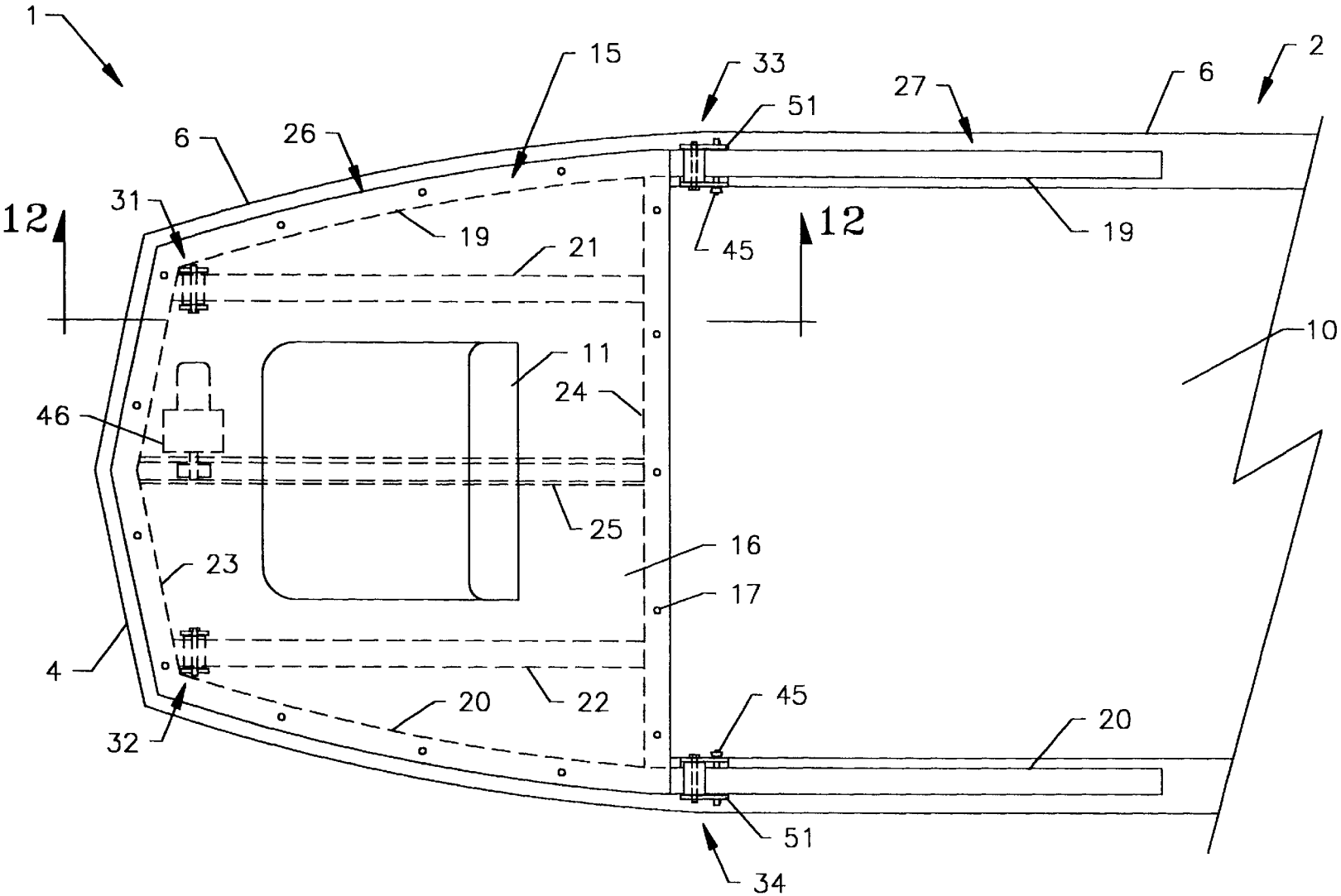
FIG. 11 is a plan view of a boat adapted with an extendable deck assembly mounted with bracket assemblies, shown with the deck in the retracted position.
Figure 12:
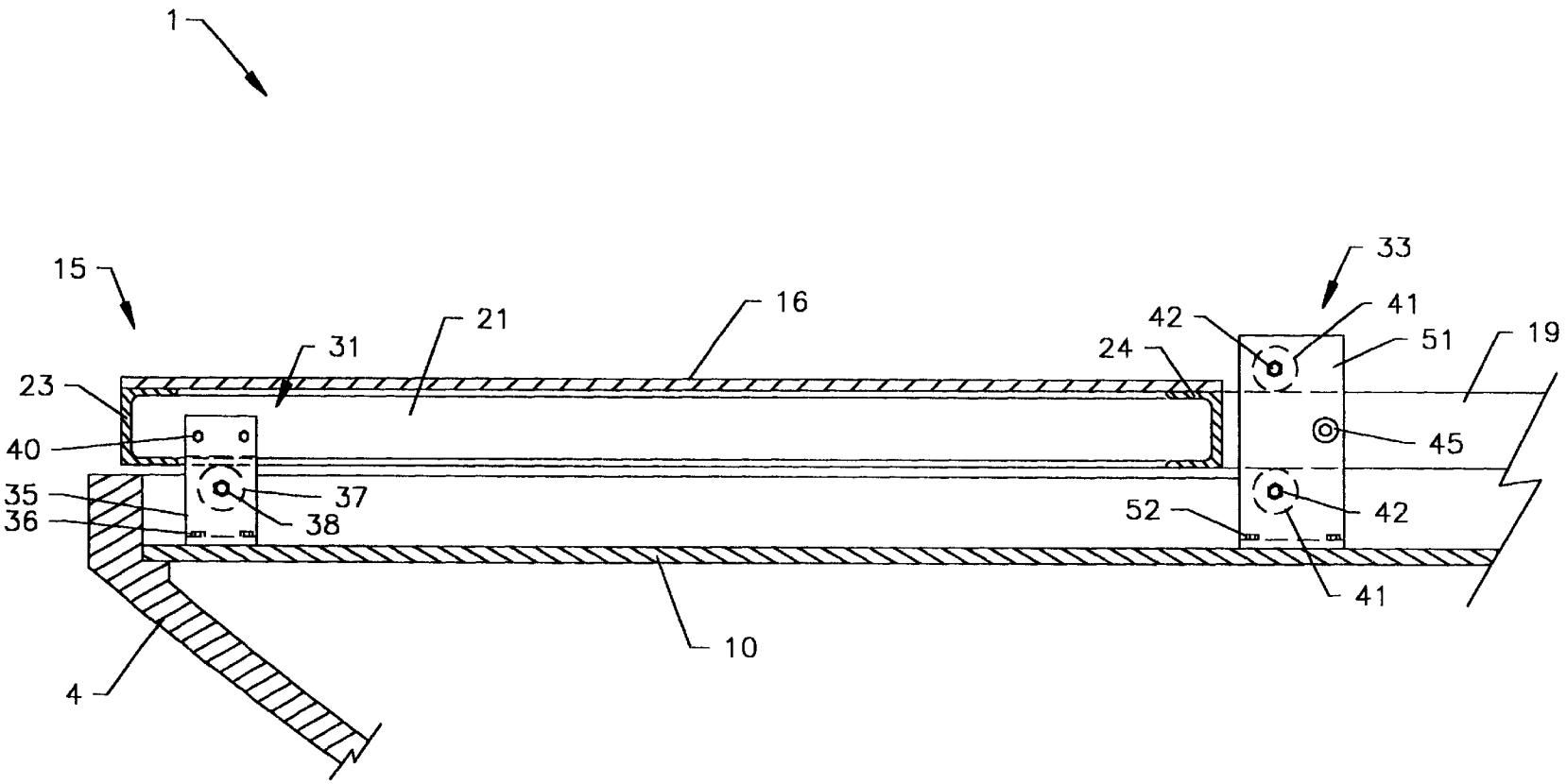
FIG. 12 is a horizontal section view taken along line 12—12 of FIG. 11.

Referring to FIGS. 11 and 12, the extendable deck assembly 1 is provided with back guide roller mounting brackets 51 for installation on existing boats as an add-on feature rather than a built-in feature. The extendable deck assembly 1 is identical to that discussed above excepting that the back guide roller assemblies 33, 34 are mounted in guide roller brackets 51 in lieu of the boat sidewall cavities 7. The guide roller brackets 51 are constructed of sheet metal and are secured to the stationary deck 10 of the boat 2 with mounting bolts 52, as shown. Clamp-on type mounting brackets may also be provided for certain boats as is obvious to anyone skilled in the art.

Figure 13:
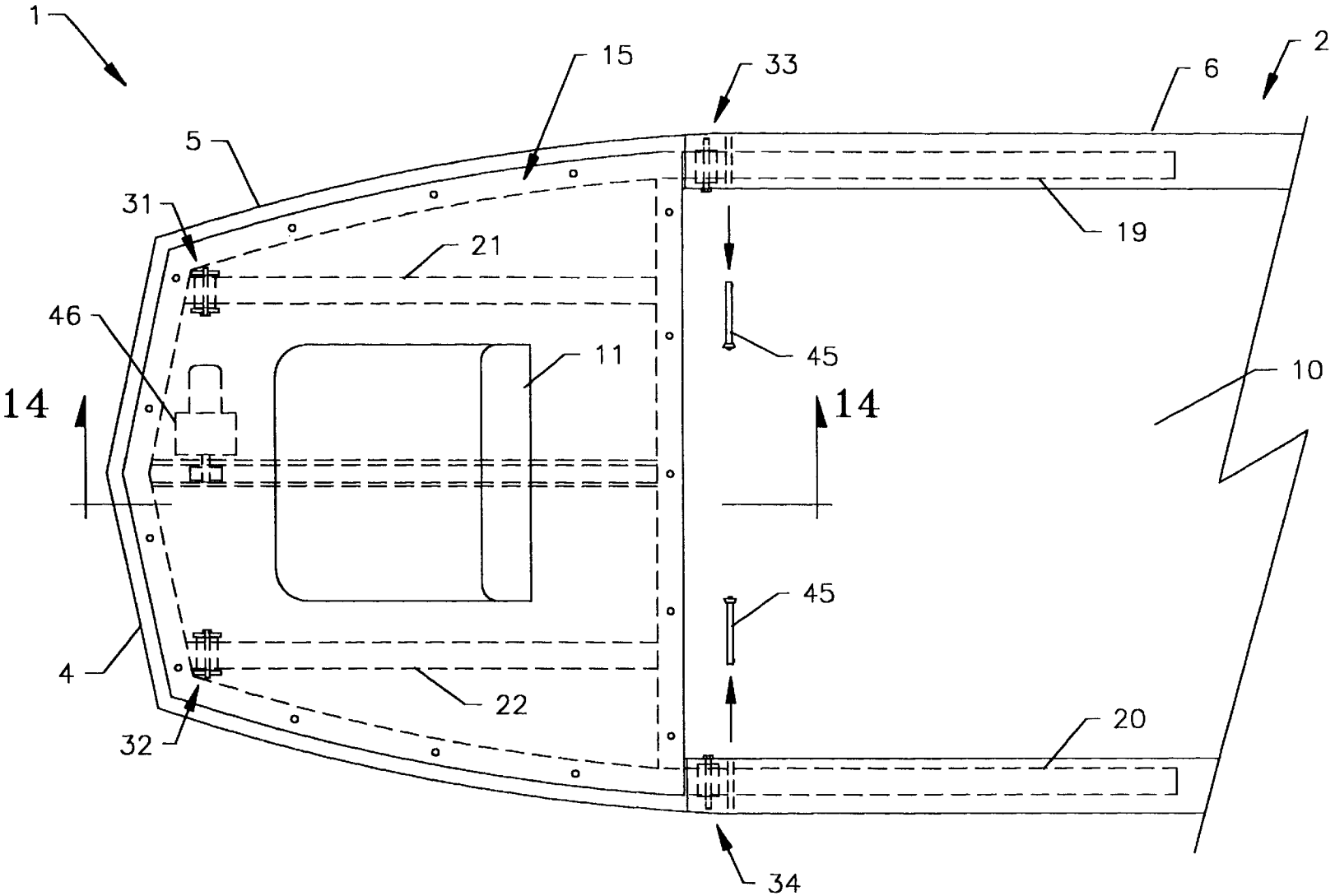
FIG. 13 is a plan view of FIG. 2 shown with the quick pins removed and the extendable deck ready for extension.
Figure 14:
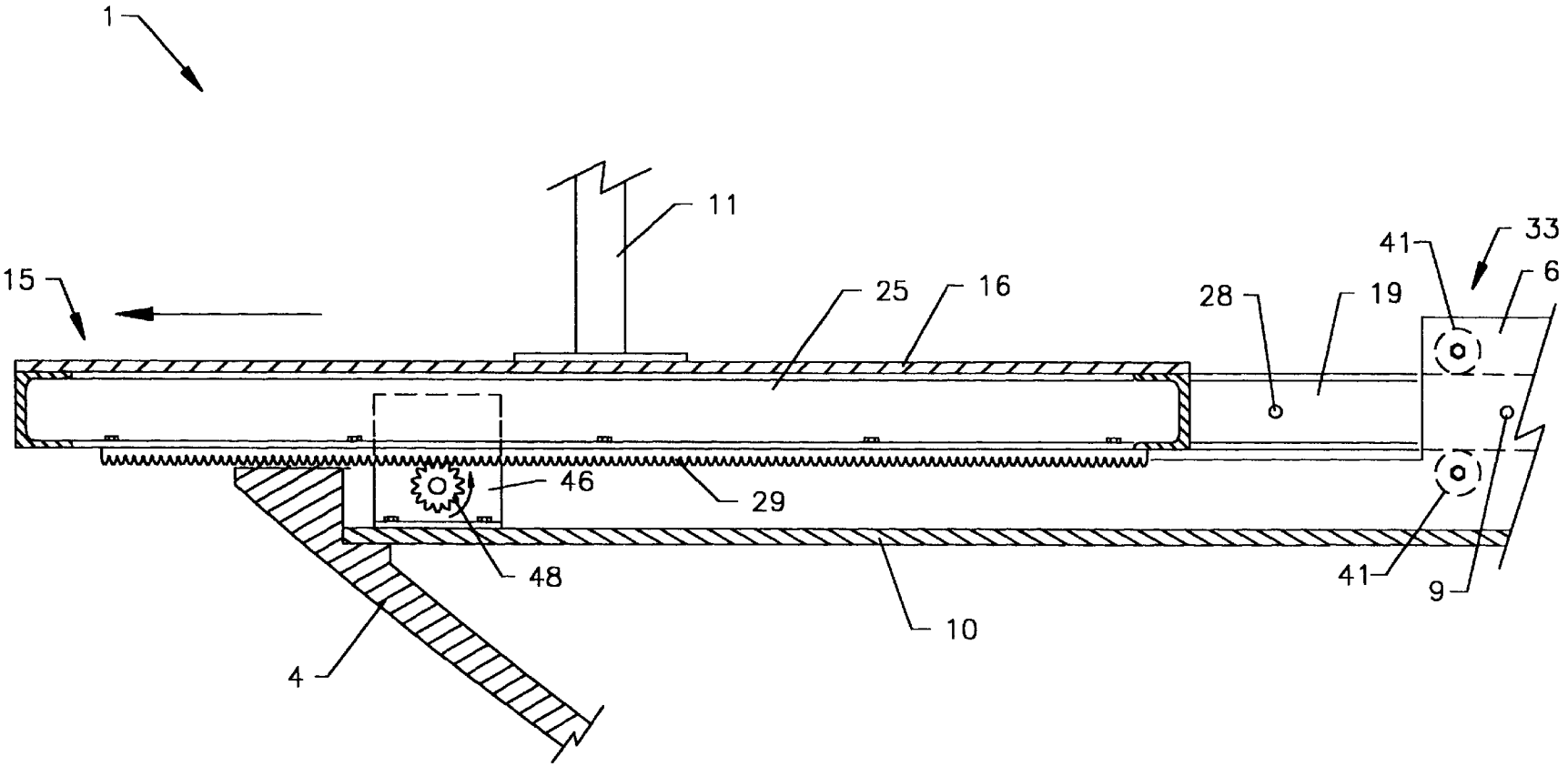
FIG. 14 is a horizontal section view taken along line 14—14 of FIG. 13 shown with the extendable deck in forward motion.
Figure 15:
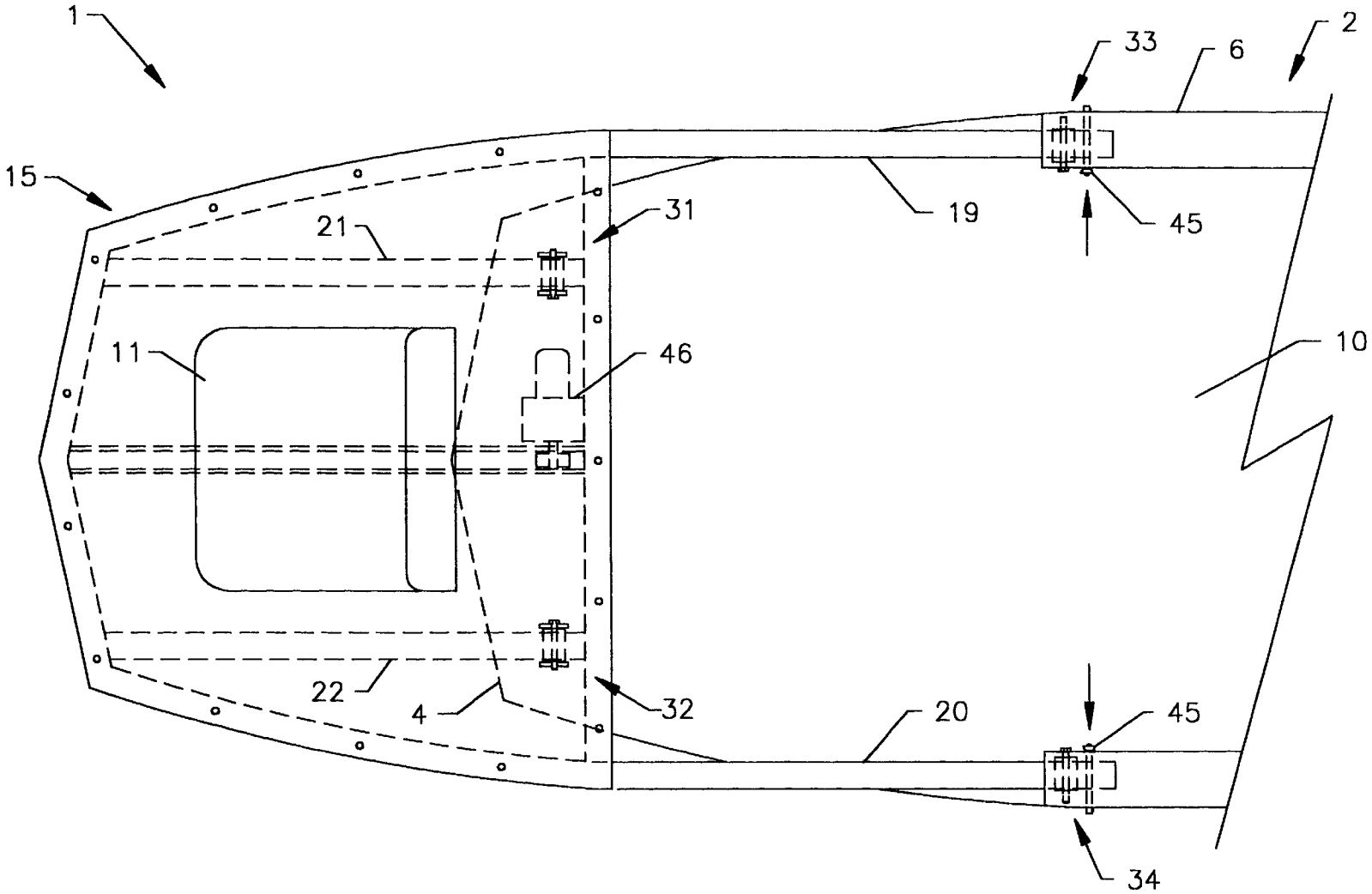
FIG. 15 is a plan view of the extendable deck assembly shown in the extended position with the quick pins inserted.
Figure 16:
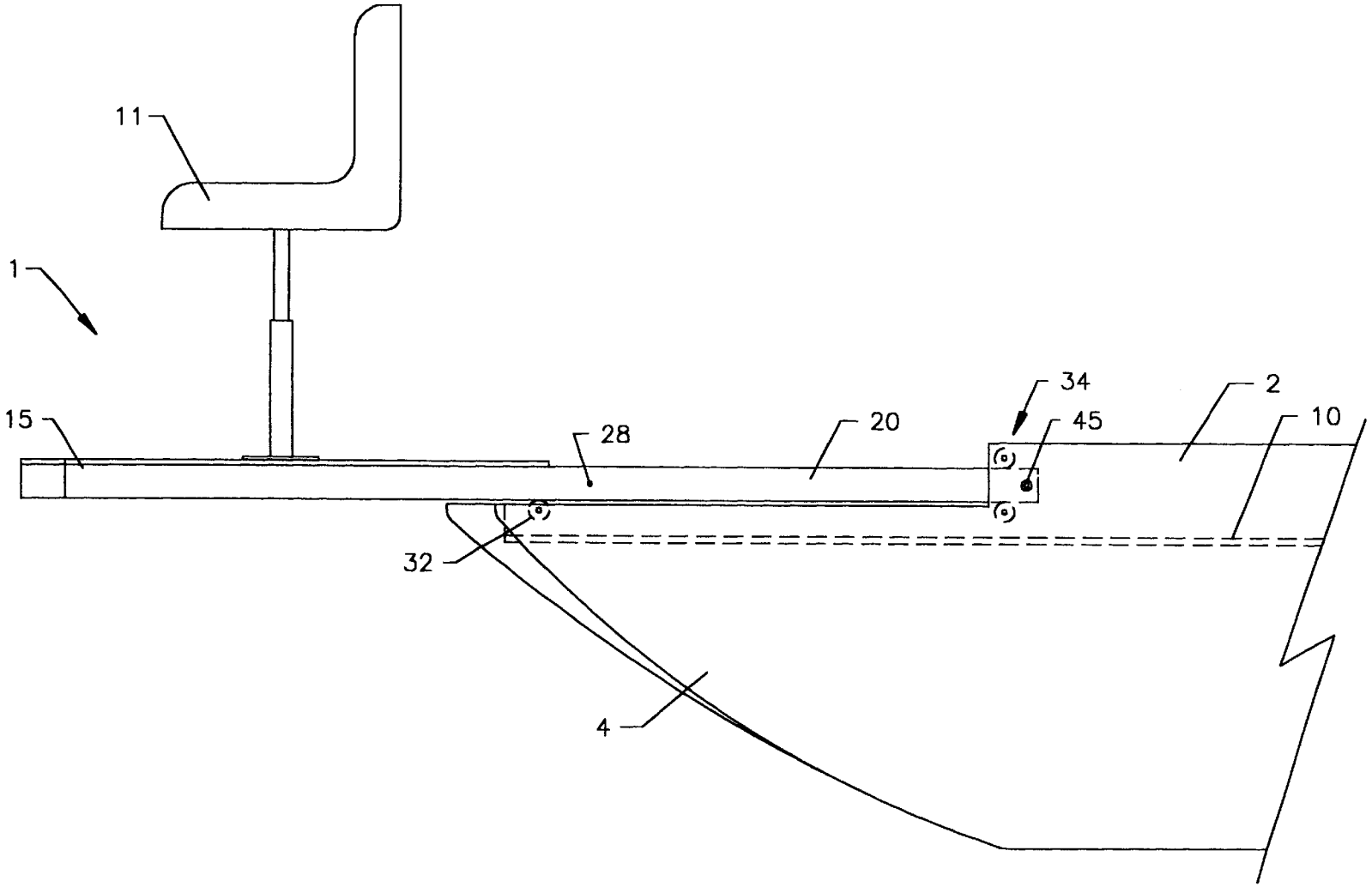
FIG. 16 is a side elevation view of FIG. 15.

In operation, the present invention is illustrated in FIGS. 13 through 16. Referring to FIG. 13, the extendable deck 15 is extended by first removing the quick pins 45 from the boat sidewall cavities 7. The extendable deck 15 is then moved forward by means of the gearmotor 46 which rotates the pinion gear 48, as seen in FIG. 14. When the extendable deck 15 is in the fully extended position, the quick pins 45 are inserted back into the boat sidewall cavities 7, as seen in FIG. 15; thereby retaining the extendable deck 15 in the extended position, as seen in FIG. 16. The extendable deck 15 may be returned to the retracted position by simply reversing the above procedure.

The extendable deck assembly 1 may be operated by any common electrical circuit easily constructed by anyone skilled in the art. A limit switch may also be employed to prevent operation of the outboard motor 3 unless the extendable deck 15 is in the fully retracted position, as seen in FIG. 1. The extendable deck assembly 1 may be actuated by various methods including hydraulic cylinders, ball screw actuators, and by powering the guide rollers, as will be obvious to anyone skilled in the art. The extendable deck assembly 1 may also be provided for manual operation in which case the gearmotor 46, pinion gear 48, and gear rack 29 are omitted.

The present invention may be provided in other modified forms without departing from the spirit and scope of the invention. The foregoing description is provided to illustrate one embodiment of the invention for purposes of this disclosure and it is intended to cover all changes and modifications which do not depart from the spirit and scope of this invention.

What is claimed is:

1. An extendable deck assembly for a boat, said boat including a stationary deck located between a bow of the boat and a stern of the boat defining a use area for occupants of said boat and having a longitudinal axis extending from the bow of the boat to the stern of the boat; said extendable deck assembly being mounted to said boat, and including an extendable deck that is movable between an extended position and a retracted position in a sliding manner, at least a portion of said extendable deck being positioned over at least a portion of the stationary deck when the extendable deck is in the retracted position, at least a portion of the extendable deck extending outwardly in a longitudinal direction from the bow of said boat when the extendable deck is in the extended position; said extendable deck assembly further including at least one guide roller mounted to said boat, and at least one guide rail mounted to said extendable deck, said guide rail being adapted to accommodate said guide roller to permit movement of said extendable deck between the extended position and the retracted position.

2. The extendable deck assembly as set forth in claim 1 further including an actuating device that is selectively energized to move said extendable deck inwardly over the stationary deck into the retracted position, or outward from the bow of the boat into the extended position.

3. The extendable deck assembly as set forth in claim 2 wherein said actuating device includes a gearmotor having an output shaft with a pinion gear mounted thereon, and a gear rack mounted to the extendable deck; said gear rack being adapted to engage the pinion gear of the gearmotor, said extendable deck being moved between the extended and retracted positions based upon the direction of rotation of the pinion gear.

4. An extendable deck for a boat having a hull and a longitudinal axis extending from a bow of the boat to a stern of the boat; said extendable deck assembly being mounted to said boat, and including an extendable deck that is movable between an extended position and a retracted position in a sliding manner, at least a portion of said extendable deck being positioned over at least a portion of the boat hull when the extendable deck is in the retracted position, at least a portion of the extendable deck extending outwardly in a longitudinal direction from the bow of said boat when the extendable deck is in the extended position; said extendable deck assembly further including at least one guide roller mounted to said boat, and at least one guide rail mounted to said extendable deck, said guide rail being adapted to accommodate said guide roller to permit movement of said extendable deck between the extended position and the retracted position.

5. The extendable deck assembly as set forth in claim 4 further including an actuating device that is selectively energized to move said extendable deck inwardly over the boat hull into the retracted position, or outwardly from the bow of the boat into the extended position.

6. The extendable deck assembly as set forth in claim 5 wherein said actuating device includes a gearmotor having an output shaft with a pinion gear mounted thereon, and a gear rack mounted to the extendable deck; said gear rack being adapted to engage the pinion gear of the gearmotor, said extendable deck being moved between the extended and retracted positions based upon the direction of rotation of the pinion gear.

7. In combination with a boat having a bow and a stern defining a use area for occupants of said boat, having a stationary deck, and having a longitudinal axis extending from the bow to the stern: an extendable deck assembly mounted to said boat including:

an extendable deck slidingly movable between an extended position and a retracted position, at least a portion of said extendable deck being positioned over at least a portion of the stationary deck when the extendable deck is in the retracted position, at least a portion of the extendable deck extending outwardly in a longitudinal direction from the bow of said boat when the extendable deck is in the extended position; and at least one guide roller mounted to said boat and at least one guide rail mounted to said extendable deck and in contact with said guide roller as to permit movement of said extendable deck between the extended position and retracted position.

8. An extendable deck assembly adapted to be secured to a stationary deck of a boat and slidably movable between an extended position and a retracted position, at least a portion of said extendable deck being positioned over at least a portion of the stationary deck when the extendable deck is in the retracted position, and at least a portion of the extendable deck extending outwardly in a longitudinal direction from an edge of the stationary deck when the extendable deck is in the extended position; said extendable deck assembly including at least one back guide roller mounting bracket adapted to be mounted to said boat, at least one guide roller mounted to said back guide roller mounting bracket, and at least one guide rail mounted to said extendable deck and in contact with said guide roller as to permit movement of said extendable deck between the extended position and retracted position.

9. The extendable deck assembly of claim 8 wherein the back guide roller mounting bracket is adapted to be mounted to said stationary deck of said boat.

10. An extendable deck assembly for a boat suitable for operation on a lake, said boat including a stationary deck located between a bow of the boat and a stern of the boat defining a use area for occupants of said boat and having a longitudinal axis extending from the bow of the boat to the stern of the boat; said extendable deck assembly being mounted to said boat, and including an extendable deck movable between an extended position and a retracted position in a sliding manner, said extendable deck being positioned substantially parallel to said stationary deck in all usable positions; at least a portion of said extendable deck being positioned over at least a portion of the stationary deck when the extendable deck is in the retracted position, at least a portion of the extendable deck extending outwardly in a longitudinal direction from the bow of said boat when the extendable deck is in the extended position.

11. An extendable deck for a boat suitable for operation on a lake, said boat having a hull and a longitudinal axis extending from a bow of the boat to a stern of the boat; said extendable deck assembly being mounted to said boat, and including an extendable deck that is movable between an extended position and a retracted position in a sliding manner, at least a portion of said extendable deck being positioned over at least a portion of the boat hull when the extendable deck is in the retracted position, at least a portion of the extendable deck extending outwardly in a longitudinal direction from the bow of said boat when the extendable deck is in the extended position, said extendable deck remaining substantially horizontal in all usable positions.

* * * * *